US005784976A

United States Patent [19]

Burdick

[11] Patent Number: 5,784,976

[45] Date of Patent: Jul. 28, 1998

[54] WEIGHTED DAGGERBOARD STABILIZER FOR WIND SURFING APPARATUS

[76] Inventor: James F. Burdick, 338 Dumbarton Rd., Baltimore, Md. 21212

[21] Appl. No.: 795,210

[22] Filed: Feb. 5, 1997

[51] Int. Cl.[6] ..... B63B 35/79

[52] U.S. Cl. ..... 114/39.2; 114/132; 114/141

[58] Field of Search ..... 114/39.1, 39.2, 114/127, 128, 131, 132, 140, 141, 142, 121; 441/74, 79

[56] References Cited

U.S. PATENT DOCUMENTS

| | | | |
|---|---|---|---|
| 602,684 | 4/1898 | Henry . | |
| 3,381,648 | 5/1968 | Vonck . | |
| 3,747,550 | 7/1973 | Stoeberl | 114/140 |
| 4,331,093 | 5/1982 | Moller | 114/39.2 |
| 4,508,046 | 4/1985 | Coulter et al. . | |
| 4,667,615 | 5/1987 | Marker | 114/132 |
| 4,715,304 | 12/1987 | Steinberg . | |
| 5,069,648 | 12/1991 | Ozeki . | |
| 5,129,344 | 7/1992 | Ono et al. | 114/132 |

FOREIGN PATENT DOCUMENTS

| | | | |
|---|---|---|---|
| 2405864 | 6/1979 | France | 114/140 |
| 2464181 | 4/1981 | France . | |
| 3830820A | 3/1990 | Germany . | |

*Primary Examiner*—Stephen Avila
*Attorney, Agent, or Firm*—Lowe Hauptman Gopstein & Berner

[57] ABSTRACT

A wind surfing apparatus formed with a hull supporting a mast and sail includes a removable daggerboard having a weighted mass in a lower end portion thereof to lessen the tendency of the hull to be unstable or flip during use. The weighted mass may either be integrally molded into the daggerboard lower portion such as with fiberglass materials, or may be releasably attached to the daggerboard to allow for selection of a desired amount of weight. The wind surfer apparatus further includes a ratchet mechanism for controllably selecting and maintaining a desired orientation of the daggerboard stabilizer relative to the hull during use.

25 Claims, 7 Drawing Sheets

WEIGHTED DAGGERBOARD STABILIZER FOR WIND SURFING APPARATUS

TECHNICAL FIELD

The present invention relates generally to wind surfing apparatus and, more particularly, to wind surfing apparatus employing retractable hydrofoils or daggerboards, these terms being used interchangeably herein.

BACKGROUND ART

Wind surfing apparatus are generally formed with a hull to which a mast and sail are pivotally mounted to project upward from the hull during sailing. The hull is usually in the form of a sail board having a somewhat flat top surface upon which the user stands in counterbalanced relationship to the sail, and a lower surface which is hydrodynamically formed to move through the water under sail power. At appropriate speeds, the hull is capable of hydroplaning as is well known.

A removable daggerboard or hydrofoil projects downward from the hull, rearwardly of the mast, to counterbalance the wind force acting upon the sail when the wind is from the side or the front of the board; the conventional daggerboard also provides a small degree of rotational stability about the long axis of the board.

The daggerboard is constructed and arranged to be removably mounted on the hull in a manner enabling rapid mounting and de-mounting while also being rigidly secured in use. This is often achieved by providing a through slot in the central portion of the hull that communicates with top and bottom surfaces thereof. The lower end of the daggerboard is inserted into the open top of the slot and slides downwardly until restrained by a pair of pivot protrusions which are received and cradled within a pair of shallow depressions formed in the top surface of the board in communication with the slot. These pivot protrusions define a transverse pivot axis located perpendicular to the longitudinal axis of the hull.

One of problems associated with the conventional daggerboard described hereinabove is that the lower end moving through the water is hydrodynamically shaped and somewhat light in weight and therefore cannot easily resist the tendency of the board to be unstable by rolling along its longitudinal axis or to actually flip over. The tendency of the hull to be unstable is a particular problem for novice board sailors and frequently is a sufficient source of frustration for the novice sailor so as to discourage board sailing instruction. The problem of tipping or flipping also plagues intermediate level sailors particularly when learning to do beach starts, water starts and jibes.

It is accordingly an object of the present invention to resist the tendency of wind surfing apparatus to flip.

Another object of the invention is to improve rotational stability of wind surfing apparatus.

Still a further object is to stabilize wind surfing apparatus by greatly damping the approximately 45°–60° normal range of rotation from the vertical that normally occurs.

Since the aforementioned daggerboard is removable and mounted to the hull by simple downward placement through the open vertical slot, there is a tendency for the lower submerged end of the daggerboard to pivot rearwardly during sailing which lessens its ability to counteract the wind force acting upon the sail, thereby increasing the tendency of the board to flip especially at higher speeds. To prevent this problem, the sailor must constantly or at periodic intervals apply pressure to the upper portion of the daggerboard to ensure that the daggerboard remains in its lowermost position during sailing.

In contrast to the problem identified hereinabove, advanced sailors may desire to pivot the daggerboard into different orientations relative to the hull in order to practice advanced maneuvers or to accomplish beach starts under conditions of shallow depth and gradual bottom slopes where considerable horizontal distances must be traversed before the daggerboard can be pivoted into its lowermost and deepest position.

A further object is to positively control the orientation of the removable daggerboard relative to the hull.

Another object is to prevent pivotal movement of the daggerboard during sailing by positively maintaining the daggerboard at a fixed orientation with respect to the hull irrespective of sail speeds.

SUMMARY OF THE INVENTION

The present invention is directed to a wind surfer apparatus comprising a hull board with a mast and sail mounted to project upward from the hull during sailing. The mast may be conventional and centrally universally pivotally mounted on the top of the hull board by a conventional universal joint mast mounting assembly. A daggerboard is removably mounted to project downward from the hull into the water during sailing. The daggerboard acts to inhibit lateral movement of the hull in response to the force on the sail, producing with the forward force on the sail a resultant force vector that drives the rig forward, in the same manner that a keel of a boat acts. It also acts to stabilize the hull while resisting the tendency of the apparatus to roll or flip about its longitudinal axis during sailing.

In accordance with the present invention, a weight is attached to the submerged end of the daggerboard to advantageously lessen the tendency of the wind surfer apparatus to oscillate about the board's long axis, or flip, during use.

The weight may be secured to the lower end of the daggerboard in a variety of ways. For example, a fixed amount of weight may be integrally molded into the daggerboard lower end by the use of an encapsulation material, such as fiberglass. Alternatively, or in conjunction therewith, a predetermined amount of weight may be attached to the daggerboard lower end using either mechanical fasteners or clamping mechanisms (e.g., of the quick-release type) or a combination of both so that the user may adjust the amount of weight in the daggerboard during set-up to allow for beach conditions.

A cavity opening to one edge of the weight receives the lower end of the daggerboard which may be retained within the cavity by means of screws or the like. The exterior shape of the weight is preferably designed to provide appropriate hydrodynamic characteristics during sailing movement. The cavity is preferably formed to communicate with the top edge of the weight so that this cavity shape and size may be formed in any number of different weighted masses for selective attachment to the lower end of the same daggerboard. For example, by forming the same size cavity in weights of different masses, the sailor may select for use a weight having a mass in a practical range from about 5–50 pounds.

In accordance with another feature of this invention, there is provided a means for fixing the relative orientation of the removable daggerboard relative to the hull. Such fixing means enables the daggerboard to pivot within a longitudinal vertical plane extending perpendicular to the top surface of the hull to assume selected angles of inclination relative to the longitudinal axis. The fixing means is further movable into a neutral position out of positive contact with the daggerboard to enable the sailor to select either positive control or provide the sailor with the ability to control the daggerboard orientation in a conventional manner.

In a preferred embodiment, the fixing means includes a ratchet mechanism pivotally mounted to the top surface of the hull in spaced relation to the daggerboard pivot axis. The ratchet mechanism carries a pawl engageable with at least one of a series of ratchet protrusions formed in an upper portion of the daggerboard. The pawl is resiliently biased into a selected protrusion by means of a pair of tension springs. Tension is transmitted to the springs by appropriate adjustment of a handle assembly operatively connected to the springs.

The weighted daggerboard and ratchet mechanism features may be used either independently or in conjunction with each other.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
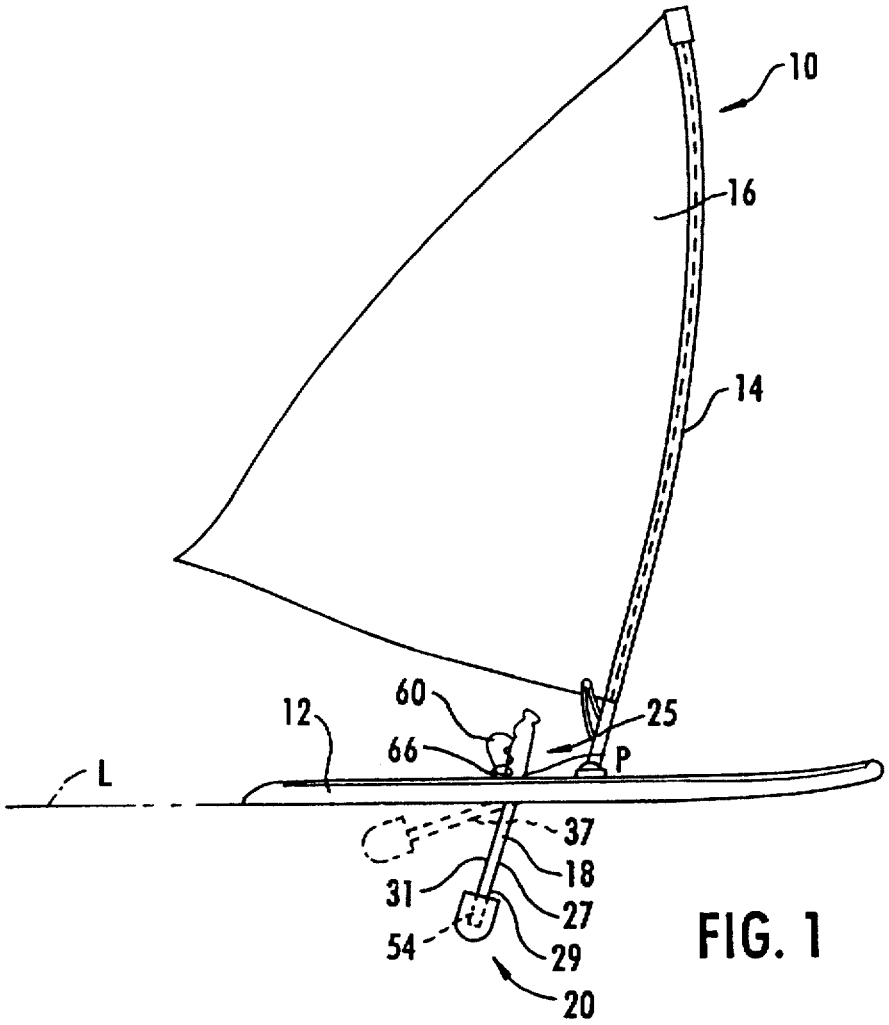
FIG. 1 is a perspective view of a wind surfing apparatus constructed in accordance with a preferred embodiment of the present.

Referring to FIG. 1, a wind surfer apparatus 10 constructed in accordance with a preferred embodiment of the present invention comprises a hull board 12, a mast 14, and a sail apparatus 16 of conventional construction and use. At least one removable daggerboard 18 extends downwardly through the hull 12 into the water and is uniquely formed with a weighted lower portion 20 to reduce rotational stability by resisting the tendency of the board to roll or tip about its longitudinal axis L. In this manner, novice sailors will be able to learn to do board sailing, and maneuvers by any sailor will be learned more easily with less effort.

Figure 3:
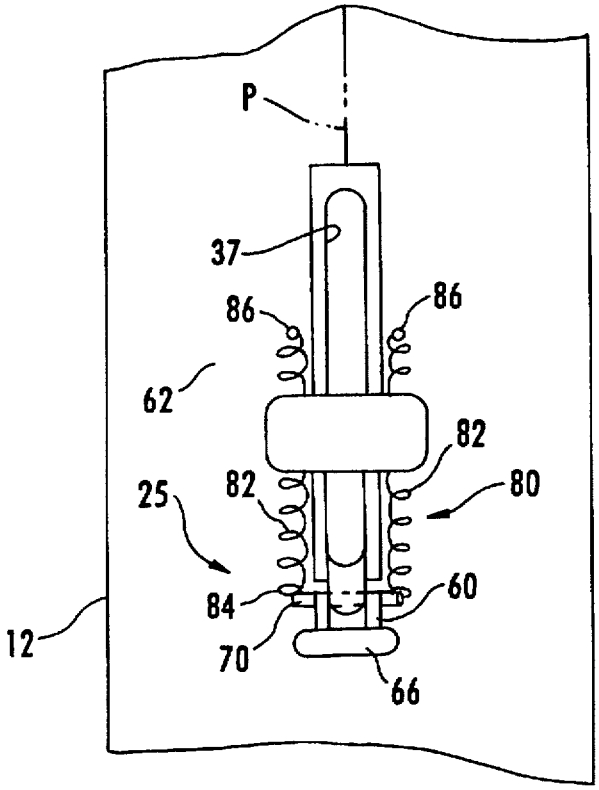
FIG. 3 is a top plan view illustration of the daggerboard and ratchet mechanism in accordance with the present invention.

In accordance with another feature of this invention, best depicted in FIGS. 1 and 3, the daggerboard 18 is constructed to be selectably positionable in terms of its orientation within a vertical plane P to the longitudinal axis L of the hull 12. This selectable orientation (see, e.g., the solid and phantom line positions in FIG. 1) is fixed by means of a uniquely designed ratchet assembly generally designated with reference numeral 25, that may be easily controlled by the sailor to either maintain the daggerboard 18 in a fixed orientation, or to change orientation, or to enable conventional use of the daggerboard by deactivating the ratchet mechanism. As will be seen more fully below, the ratchet mechanism assembly 25 may be used in combination with the weighted daggerboard portion 18,20 of the invention, or may be used to control the orientation of a conventional unweighted daggerboard.

When used with a weighted daggerboard, ratchet mechanism assembly 25 is preferably mounted aft (see FIG. 1) of the daggerboard for engagement with one or more teeth formed in an aft facing section of the daggerboard. The ratchet mechanism assembly 25 may be mounted forward of the daggerboard to engage forward facing teeth when the daggerboard is unweighted. Aft positioning of the ratchet 25 is desirable when used with a weighted daggerboard since the weight of the daggerboard will hold the ratchet in locked engagement with the daggerboard teeth. Aft positioning is also desirable since the sailor spends most of the time aft of the daggerboard. As will be discussed more fully below with reference to the FIG. 6 and 7 embodiments of the ratchet mechanism, it is possible to design the ratchet mechanism for use in either forward or aft positions.

Figure 1A:
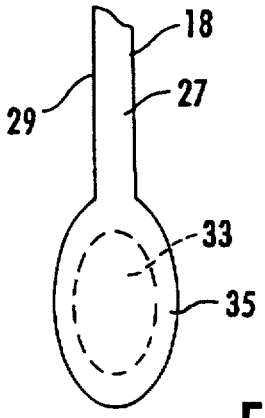
FIG. 1A is an enlarged view of a lower portion of a weighted daggerboard in accordance with a second embodiment of the invention.

The weighted daggerboard 18 is an elongate, hydrodynamically shaped member having opposing generally vertically extending wide faces 27 terminating in leading and trailing edges 29 and 31 which are suitably tapered in a known manner to stabilize the direction of movement of the hull board 12 with minimal drag. The wide faces 27 are oriented parallel to the direction of sailing movement are adapted to resist rotational instability and lateral movement inherently caused by the wind acting on the sail 16. In one alternate embodiment of the invention depicted in FIG. 1A, the ability to resist rotational instability is further imparted to the daggerboard 18 by molding a weighted mass 33 into the lower end thereof such as with an encapsulation material 35 that may be fiberglass, epoxy, or a combination thereof. The weighted mass is preferably selected to be in the range of 5–50 pounds and is molded so that the lower weighted end 33,35 of the daggerboard 18 has a hydrodynamic shape in the manner depicted in FIGS. 5 and 6. Preferably, the longitudinal and lateral dimensions of the encapsulated, weighted lower end 20, or 33,35, is less than the corresponding dimensions of the through slot 37 through which the end is initially inserted into the hull board 12 during placement of the daggerboard 18 into the hull.

To protect the daggerboard slot 37 from wear or abrasion due to the extra weight of the weighted daggerboard, it may be desirable to use an insert to line the slot walls and the pivot for the board, e.g., a metal lining insert shaped to conform to the slot walls and pivot sockets.

The feature of providing additional weight in the lower end of a removable daggerboard 18 imparts stability to the wind surfing apparatus 10 by providing ballast that resists the tendency of the board 12 to roll about its longitudinal axis L under improperly counterbalanced conditions caused by a combination of wind gusting and user inexperience in placement of weight on their feet or in the necessary stance. Molding of the weight 33 into the lower end by the daggerboard manufacturer ensures proper weight calibration for different boards and users of varying levels of experience. Encapsulation of the weight 33 into the daggerboard 18 itself also shields the weighted material from the hostile marine environment.

Figure 5:
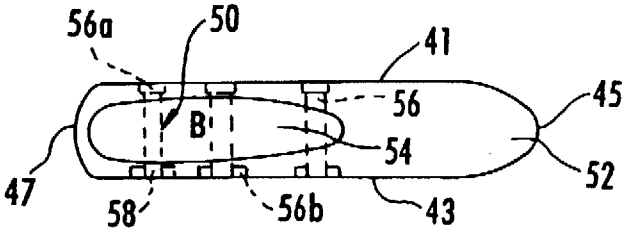
FIG. 5 is a top plan view of the weight of FIG. 4.
Figure 5A:
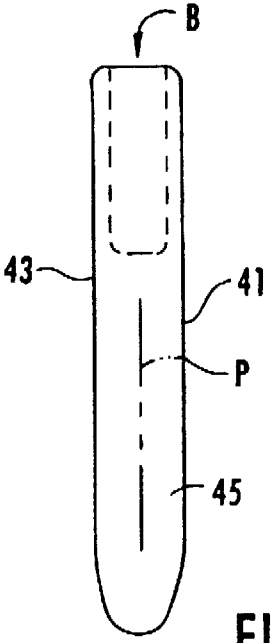
FIG. 5A is a rear end plan view of the weight of FIG. 4.
Figure 4:
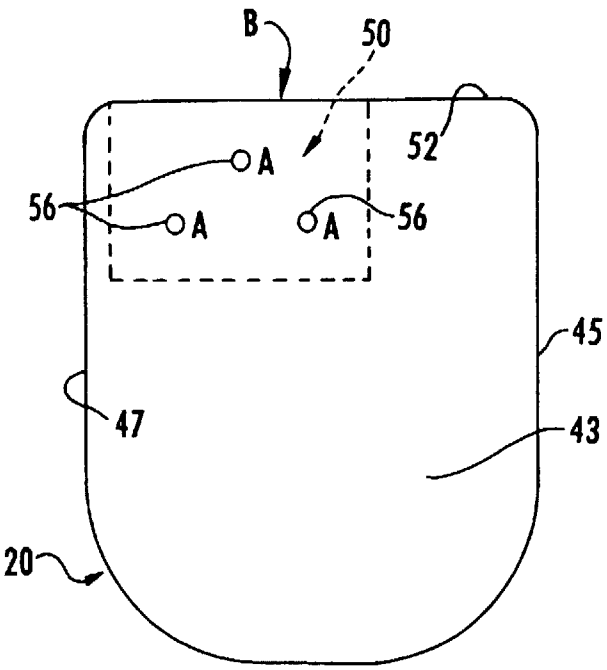
FIG. 4 is a side plan view of one of a series of preferably identical weights that may be removably secured to the lower end of the daggerboard.

In accordance with a preferred embodiment of the invention, the weight 20 is preferably fixed to the lower end of the daggerboard 18 in a replaceable manner such as with screws, clamps and the like. With reference to FIGS. 4–6, the weight 20, preferably casted from lead, is formed with a pair of opposing wide faces 41 and 43 and leading and trailing tapered edges 45 and 47 that are preferably hydrodynamically shaped to avoid interference with the hydrodynamic characteristics of the daggerboard 18 projecting upwardly therefrom in an otherwise conventional manner. An upwardly directed mounting cavity 50 is uniquely formed in the top edge 52 of the weight 20 and has a cross sectional area in top plan view (FIG. 5) corresponding to the cross-section of the lower end 54 of the daggerboard 18 for snug fitting insertion therein. The daggerboard lower end 54 is preferably retained in the mounting cavity 50 by means of three or four screws 56 passing through the cavity side walls 58 and the daggerboard lower end to ensure positive locking retention of the weight 20 to the daggerboard 18. Preferably, the screws 56 are flathead bolts 56*a* received in a countersunk opening in one face 41 with a nut 56*b* received in another countersunk in the opposing face 43 to avoid projecting from the faces.

The feature of attaching the weight 20 to the daggerboard lower end 54 in the manner of the invention advantageously enables selection by the sailor of a desired amount of weight, typically between 5–50 pounds. Accordingly, it is contemplated that the daggerboard 18 of the invention may be sold in a kit form consisting of a daggerboard and at least one weight 20 formed with a mounting cavity 50 adapted to receive the daggerboard lower end 54 as described above, and, optionally also a package of screws 56 or other types of fastening means for securing or clamping the lower end within the cavity.

Figure 2:
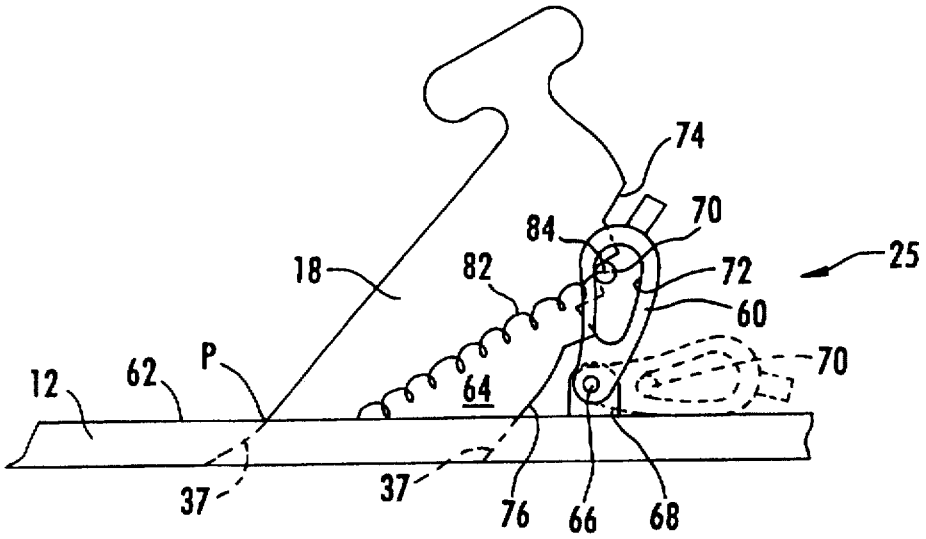
FIG. 2 is an enlarged partial elevational view of one embodiment of the ratchet mechanism depicted in FIG. 1 for selecting and maintaining a predetermined orientation between the daggerboard and hull board.

Depending upon the skill level of the wind surfer, as well as wind and beach conditions, it is often desirable to pivot the daggerboard 18 relative to the hull longitudinal axis L about a transverse pivot axis P to control the extent to which the daggerboard 18 projects into the water and to vary hydrodynamic performance of the wind surfer. In the past, a wind surfing sailor would typically use their feet to pivot the conventional un-weighted daggerboard into a desired orientation and maintain the daggerboard in a particular position based upon experience and feel. However, the weighted lower end 20 of the daggerboard 18 according to the present invention tends to bias the daggerboard into its lowermost position (solid line position of FIG. 1), particularly at lower speeds, interfering with the sailor's ability to adjust the daggerboard to different settings. If it is desired to overcome this fixed orientation, the ratchet mechanism 25 or another type of locking assembly is used to control the orientation of the retractable and selectably movable daggerboard assembly. As best depicted in FIGS. 2 and 3, the ratchet assembly 25 is comprised of a pair of parallel ratchet arms 60 pivotally mounted to the top surface 62 of the hull 12 at a location spaced forwardly of the upper end 64 of the daggerboard 18 projecting above the hull top surface from the vertical through slot 37. More specifically, a transversely extending pin or shaft 66 passes through the lower ends of the ratchet arms 60 for connection to the hull 12 through a pair of mounting ears 68. A transversely extending ratchet pawl 70, preferably rod- shaped, extends between the ratchet arms 60 and has opposite ends thereof received respectively in an elongate mounting slot 72 formed in the distal end of each arm.

The ratchet pawl 70 extends perpendicular to the hull longitudinal axis L and is pivotable in a forward (clockwise) direction into engagement with one of a plurality of ratchet recesses or protrusions 74 arranged in an arc along a rearward facing edge 76 of the upper handle portion 64 of the daggerboard 18 projecting upwardly from the daggerboard mounting slot 37. Pivotal movement of the ratchet mechanism 25 may be controlled by the sailor's hands or feet to ensure ratcheted engagement with a selected one of the protrusions 74. Since each ratchet protrusion 74 preferably moves in an arcuate path having the daggerboard pivot shaft P as its center of rotation, the feature of supporting the opposite ends of the ratchet pawl 70 in an elongate slot 72 extending radially relative to the ratchet arm pivot axis 66 advantageously assures reliable engagement of the ratchet pawl with any one of ratcheted protrusions.

A biasing assembly 80, preferably in the form of a pair of tension springs 82, applies a biasing force to normally bias the ratchet pawl 70 in the direction of the ratcheted protrusions 74 to ensure reliable predetermined orientational positioning of the daggerboard 18. In the first embodiment, the rearward end 84 of each tension spring 82 is secured to an associated one of the opposite ends of the ratchet pawl 70. The springs 82 extend parallel to each other on either side of the daggerboard mounting slot 37 for pinned connection to the top surface 62 of the hull 12 with a pin or screw 86.

In accordance with a further feature of this invention, the ratchet mechanism 25 is pivotable into an aft (if the mechanism is installed aft of the daggerboard) disengaged position out of contact with the ratcheted protrusions 74 where it lies flat against the hull top surface 12 as depicted in phantom line in FIG. 2. By locating the ratchet arm pivot axis 66 to be elevationally higher than the radially inwardmost position of the ratchet pawl 70, the spring force of the tensioning assembly 80 can be further used to positively bias the ratchet mechanism 25 in the forwardmost neutral position. In this manner, the daggerboard 18 can be easily mounted and dismounted from the hull 12 and used in a conventional manner.

Figure 6A:
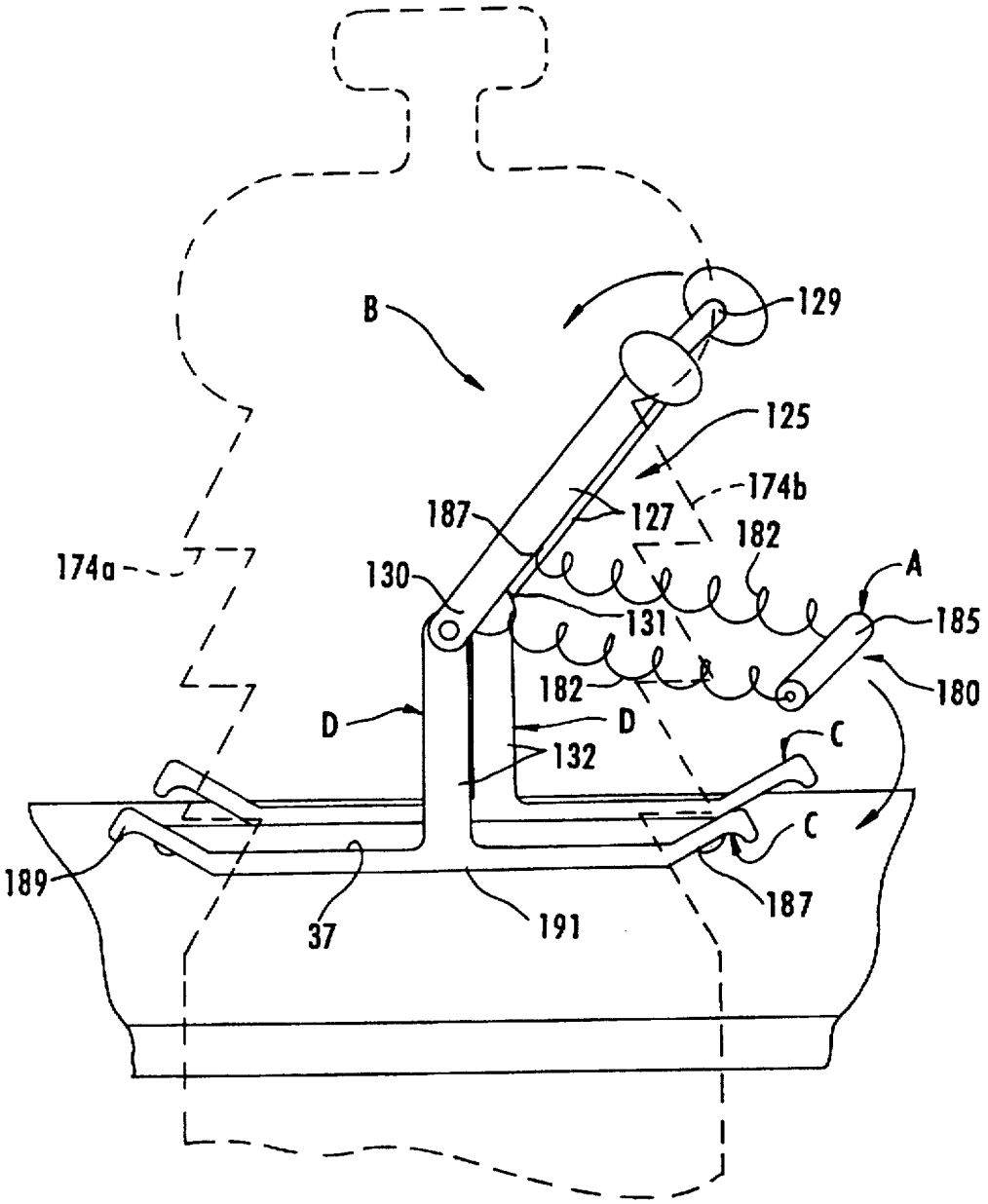
FIG. 6A is a side elevational view, partly in perspective, of a second embodiment of a ratchet mechanism for use in the present invention.

In FIGS. 6A–6E, there is disclosed a second embodiment of a ratchet mechanism, that is formed with a pair of generally parallel handle arms 127 supporting a handle 129 extending transversely between distal ends thereof. Corresponding proximal ends 130 of the handle arms 127 are pivotally connected at 131 to respective upper ends of a pair of center posts 132 that project upward from opposing longitudinal sides of the daggerboard mounting slot 37 as best depicted in FIG. 6A. The handle assembly 125 is advantageously suited for use with either a weighted or unweighted daggerboard since the handle arms 127 are of a sufficient length to tension a ratchet pawl 185 to engage either forward facing ratchet recesses or protrusions 174*a* (e.g., for use with an unweighted daggerboard), or for engagement with plural aft facing ratchet recesses or protrusions 174*b* for use with a weighted daggerboard.

Figure 6B:
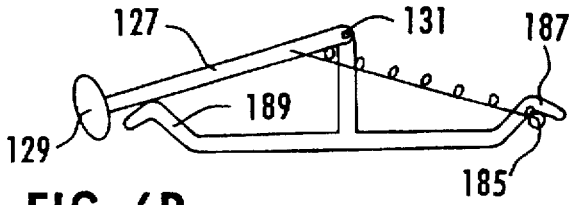
FIGS. 6B–6E are side views, partly schematic, depicting the ratchet mechanism of FIG. 6A in selective use in either forward or aft positions.
Figure 6C:
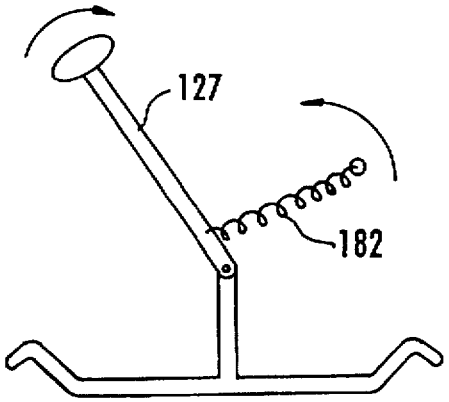
Figure 6D:
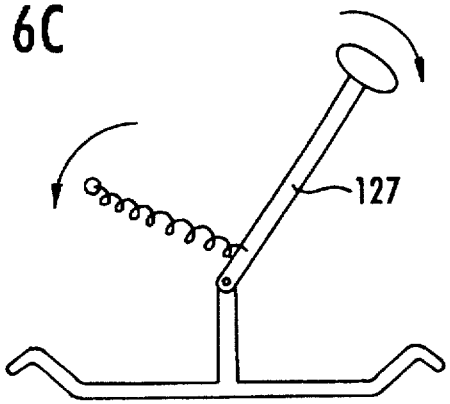
Figure 6E:
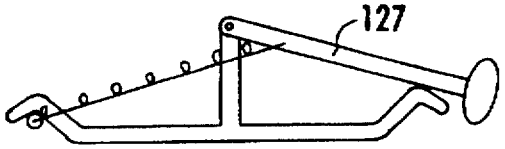

A biased ratchet assembly 180, preferably in the form of a pair of tension springs 182, applies a biasing force to normally bias the ratchet pawl 185 in the direction of the ratcheted protrusions 174*a* or 174*b* to ensure reliable predetermined orientational positioning of the daggerboard. In this second embodiment, the ratchet pawl 185 is respectively connected at opposite ends thereof to common ends of the springs 182 while the other ends of the springs are respectively connected to intermediate portions 187 of the handle arms. With this construction, the pawl 185 can be positioned beneath one of two pairs of rearward or forward restraining horns 187 or 189 to engage one of ratchet teeth 174*a* or 174*b* located beneath the horns, under spring bias achieved by rotation of handle 125 in the opposite direction. For example, FIG. 6B is an illustration of the ratchet assembly 180 pivoted into an operating position to engage the aft teeth on the weighted daggerboard (not shown for ease of illustration). With this unique arrangement, the ratchet pawl 185 may alternatively be used with an unweighted daggerboard to hold it down against the force of the water, simply by removing the ratchet 185 from beneath the aft restraining horns 187 (from the FIG. 6B position), followed by pivoting of the ratchet assembly 180 from the aft to the forward direction (counterclockwise in FIGS. 6C and 6D) while the handle arms 127 and handle 129 are pivoted as a unit from the forward to the aft position in the clockwise direction of FIGS. 6C and 6D. In FIG. 6E, the ratchet mechanism 125 is depicted in an engaged position for use with an unweighted board. Thereby, the ratchet mechanism 180 of the second embodiment can easily be pivoted into operative positions for use with either a weighted or unweighted daggerboard.

In the FIG. 6 embodiment, one rearward and one forward restraining horn 187,189 of each pair may be integrally formed at opposite ends of a longitudinally extending connecting member 191 that can be screwed or otherwise attached to the top surface of the hull adjacent a common edge of the daggerboard mounting slot 37. One of the two mounting posts 132 may extend upward from an intermediate portion of the longitudinal connecting member 191 and can be integrally formed therewith such as in the form of a plastic or metal casting. In this manner, two of such constructions are respectively and easily attached to the hull top surface adjacent each side of the mounting slot 37. The handle arms 127 and handle 129 can then be easily connected to the center posts 132 such as with releasably attachable pinned connections as will now occur to those skilled in the art.

In the alternative, the springs 182 can be secured at positions adjacent the slot and sized to provide tension to secure pawl 185 engaged beneath either set of horns 187,189 without handle assembly 125. This would have the advantage of being a less complicated mechanism with the possible disadvantage of being more difficult to use while underway.

In lieu of the biasing assembly 80 or 180 described hereinabove, it may be possible to simply utilize a length of resilient shock cord attached and operating in the same manner as springs 182 and pawl 185, i.e., the shock cord also functions as the pawl at one end thereof to one or both ratchet arms 127. The opposite end of the cord may support a tab (not shown) that can be engageable with one or both restraining horns.

Figure 7A:
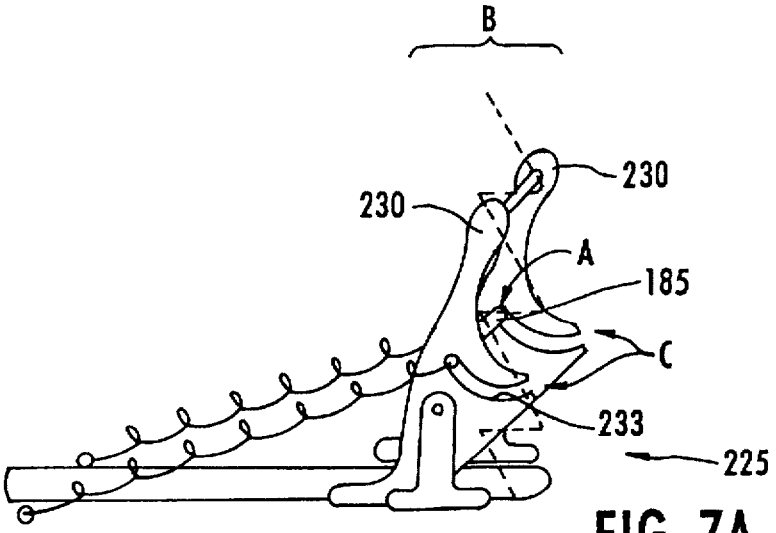
FIG. 7A is a perspective view of a third embodiment of a ratchet mechanism in accordance with the present invention.
Figure 7B:
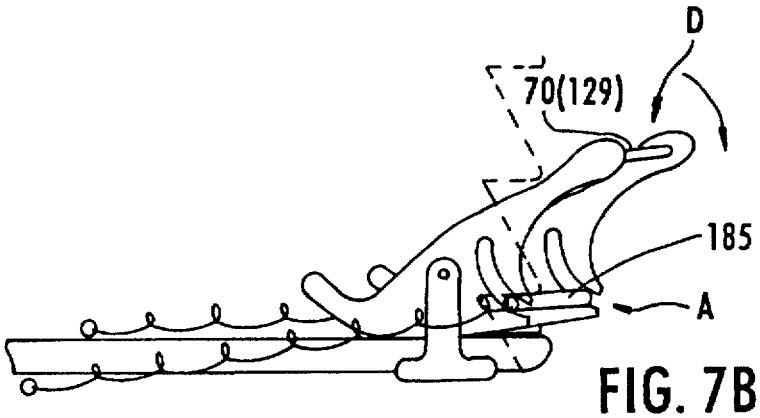
FIG. 7B is a view similar to FIG. 7A with the ratchet in disengaged position.
Figure 7C:
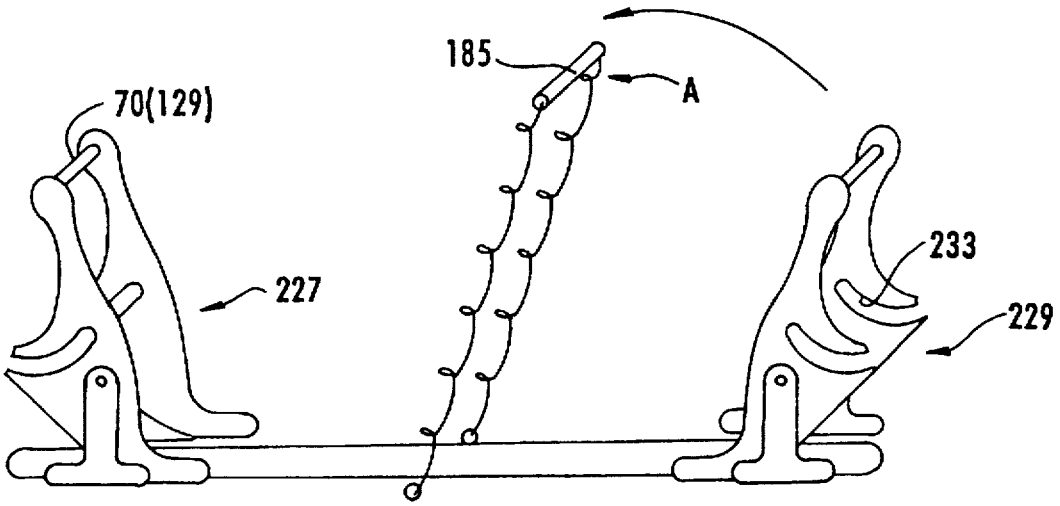
FIG. 7C is a perspective view of the ratchet mechanism being moved into operative position for forward engagement with a daggerboard.

The ratchet assembly 180 may also be used in combination with a third embodiment of a handle mechanism 225 depicted in FIGS. 7A–7C. Therein, two pairs of identical forward and rearward handle arms 227 and 229 are pivotally mounted at forward and rearward ends of the mounting slot 37. The handle 70 or 129 extends transversely between laterally spaced handle arm portions 230 to enable engagement of the ratchet pawl 185 with associated forward or rearward facing ratchet teeth 174*a*,174*b* formed in the daggerboard. Each of the handle assembly pairs 227,229 is further formed with an open slot 233 at intermediate portions thereof which open in either the forward or rearward direction as best depicted in FIG. 7C. The ratchet pawl 185 easily slips into corresponding ones of the forward or rearward slots 233 to either bias the ratchet mechanism into the engaged (FIG. 7A) or disengaged position (see FIG. 7B).

Figure 8:
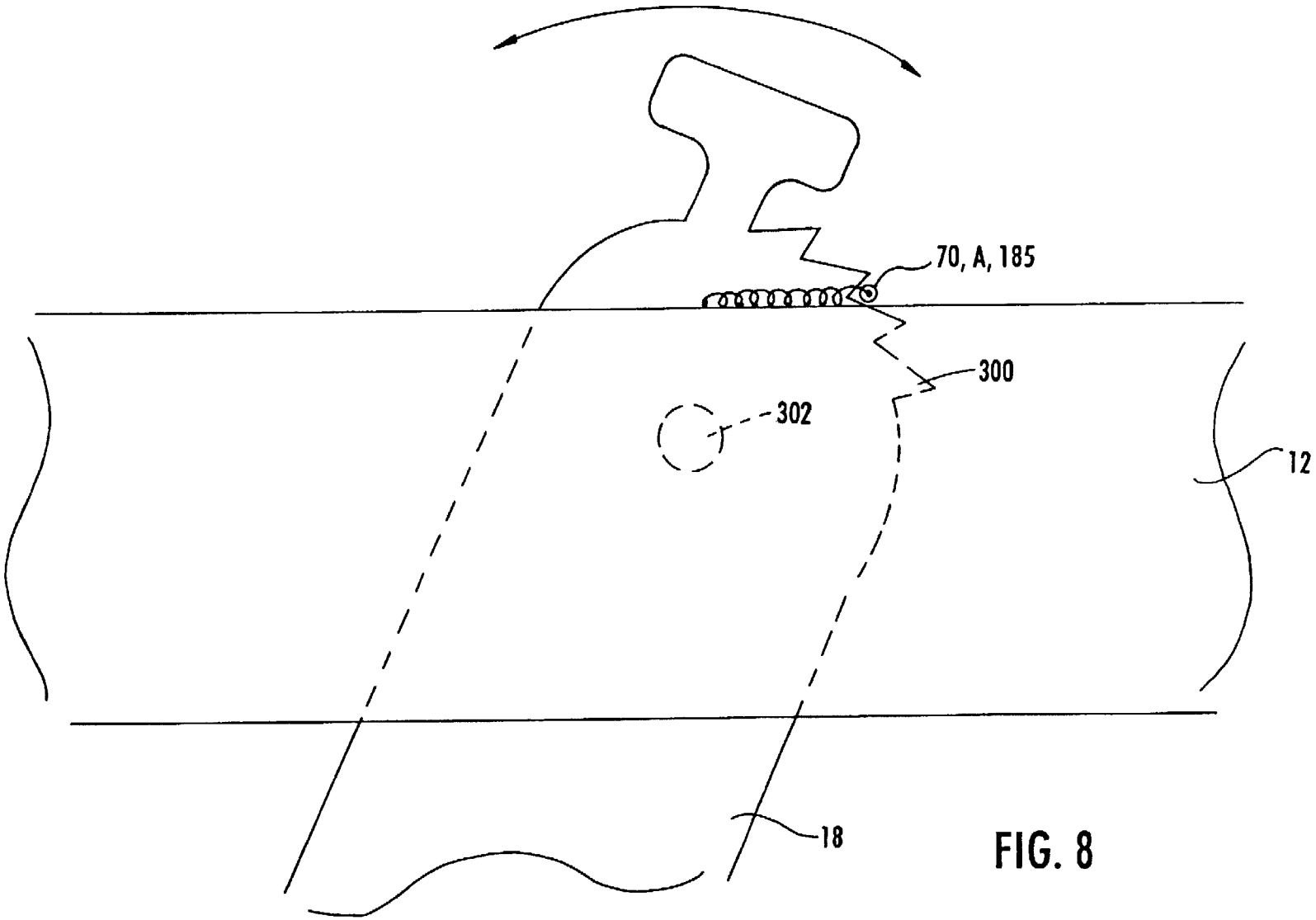
FIG. 8 is an enlarged side view of an alternate design of ratchet teeth provided on the daggerboard.

FIG. 8 is an illustration of an alternative arrangement of ratchet teeth 300 (shown on only one side of the board for ease of illustration) arrangement along an arc having a radius of curvature defined by the pivot point 302 of the daggerboard to accurately engage the ratchet pawl 70 or 185.

It is also possible, in lieu of providing a weighted daggerboard, to instead locate the weight in the lower part of the hull or as an attachment of a weighted mass to the hull bottom. Weight location in this manner would preferably be used in conjunction with an unweighted daggerboard in combination with one of the ratcheting mechanisms or equivalent thereof disclosed hereinabove. This type of weight placement has the advantage of not wearing out the hull board or the mounting slot 37 prematurely although it does not provide the same degree of leverage as would placement of weight at or near the bottom of the daggerboard.

It is also within the scope of this invention to add weight to the daggerboard by forming a cavity in the lower end of the daggerboard and disposing a weighted mass more or less entirely into the cavity for retention therein with one or more screws extending through one or more cavity side walls and the weight.

It will now be obvious to one of ordinary skill in the art from a review of this specification that other means may be provided to control the orientation of the daggerboard. Additionally, it can be further appreciated that the ratchet mechanism of the invention may also be used in conjunction with conventional or un-weighted daggerboards to counter the normal tendency of the lifting force of the water against the leading edge of the submerged portion of the daggerboard which causes the submerged portion to pivot rearwardly and upwardly at certain speeds irrespective of weight. In the case of unweighted daggerboards, the ratchet mechanism is preferably installed forward of the daggerboard in order to resist the tendency of the board to rise in the manner described above. The FIG. 6 and 7 embodiments of the ratchet assembly are uniquely suited for use in either forward or rearward locations to provide a universal type of ratchet mechanism for use with either weighted or unweighted daggerboards.

A weighted daggerboard constructed in accordance with the invention could also be used in any small sailing craft that utilizes a daggerboard.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. A windsurfer apparatus, comprising:

(a) a hull;

(b) a mast and sail mounted to project upward from the hull during sailing;

(c) a daggerboard removably mounted to project downward from the hull into the water during sailing;

(d) a weight fixedly attached to the daggerboard to lessen the tendency of the wind surfing apparatus to be unstable or flip during use.

2. The wind surfer apparatus of claim 1, further including encapsulation material adapted to mold the weight to the daggerboard.

3. The wind surfer apparatus of claim 2, wherein said weight is molded into a lower portion of the daggerboard.

4. The wind surfer apparatus of claim 3, wherein said encapsulation material includes fiberglass.

5. The wind surfer apparatus of claim 1, wherein said attaching means includes means for removably attaching the weight to the daggerboard.

6. The wind surfer apparatus of claim 1, further comprising a plurality of screws interconnecting the weight to the daggerboard.

7. The wind surfer apparatus of claim 5, wherein said removable attaching means includes a quick release device enabling clamping and unclamping of said weight to the daggerboard without screws.

8. The wind surfer apparatus of claim 1, wherein said weight includes a cavity communicating with an edge of the weight to receive a portion of the daggerboard.

9. The wind surfer apparatus of claim 8, wherein said cavity communicates with a top edge of the weight and has a generally rectangular cross-section in elevational sectional view to receive a correspondingly 5 cross-sectioned lower end of the daggerboard.

10. The wind surfer apparatus of claim 9, wherein at least one fastening element secures the weight to said lower end.

11. The wind surfer apparatus of claim 1, wherein said weight is a single mass of material having a weight selected in the range of 5–50 pounds.

12. The wind surfer apparatus of claim 11, wherein said weight is lead.

13. A wind surfer apparatus, comprising:

(a) a hull;

(b) a mast and sail mounted to project upward from the hull during sailing;

(c) a daggerboard pivotally mounted along a transverse pivot axis to project downward from the hull into the water, the pivotal mounting relationship between the daggerboard and hull enabling the daggerboard to be selectively positionable relative to the hull; and (d) a fixing arrangement for fixing the relative orientation of the daggerboard relative to the hull, said fixing arrangement being movable into a neutral position out of orientational contact with the daggerboard wherein said fixing arrangement includes a ratchet mechanism pivotally mounted in spaced relation to the pivot axis and carrying a ratchet pawl engageable with at least one of a series of ratchet protrusions formed in an upper portion of the daggerboard to fix said relative orientation.

14. The wind surface apparatus of claim 13, wherein said fixing arrangement includes means for adjusting said relative orientation through infinitely variable amounts.

15. The wind surfer apparatus of claim 13, wherein said fixing arrangement includes means for adjusting said relative orientation through discrete intervals.

16. The wind surfer apparatus of claim 13, wherein said fixing arrangement further includes a biasing assembly resiliently biasing said ratchet pawl into operational contact with a selected one of said ratchet protrusions.

17. The wind surfer apparatus of claim 13, wherein said ratchet mechanism includes a handle assembly having a pair of generally parallel handle arms pivotally mounted at lower ends thereof to the hull along a second pivot axis, each said handle arm receiving an end of a handle having a longitudinal axis parallel to the second pivot axis.

18. The wind surfer apparatus of claim 17, wherein said ratchet mechanism further comprises a pair of tension springs respectively attached to one of said handle arms and to said ratchet pawl to normally resiliently bias said ratchet pawl against one of said ratchet protrusions.

19. The wind surfer apparatus of claim 13, further comprising a weight attached to the daggerboard to lessen the tendency of the wind surfing apparatus to be unstable or flip during use.

20. The wind surfer apparatus of claim 21, further comprising means for removably attaching the weight to the daggerboard.

21. The wind surfer apparatus of claim 21, further comprising a plurality of screws interconnecting the weight to the daggerboard.

22. The wind surfer apparatus of claim 19, wherein said weight includes a cavity communicating with an edge of the weight to receive a portion of the daggerboard.

23. A wind surfer apparatus, comprising:

(a) a hull;

(b) a mast and sail mounted to project upward from the hull during sailing;

(c) a daggerboard mounted to project downward from the hull into the water during sailing; and (d) a weight attached exteriorly adjacent a lower portion of the daggerboard to lessen the tendency of the wind surfer apparatus to be unstable or flip during use.

24. A sailing craft comprising:

(a) a hull;

(b) a mast and sail mounted to project upward from the hull during sailing;

(c) a daggerboard removably mounted to project downward from the hull into the water during sailing;

(d) a weight fixedly attached to the daggerboard to lessen the tendency of the sailing craft to be unstable or flip during use.

25. A sailing craft comprising:

(a) a hull;

(b) a mast and sail mounted to project upward from the hole during sailing;

(c) a daggerboard removably mounted to project downward from the hull into the water during sailing; and (d) a weight attached to the daggerboard to lessen the tendency of the sailing craft to be unstable or flip during use; whereby removability of said daggerboard enables the daggerboard and weight to be used in different hulls for different teaching purposes and uses.

* * * * *